US006454934B2

(12) United States Patent
Inomata et al.

(10) Patent No.: US 6,454,934 B2
(45) **Date of Patent: *Sep. 24, 2002**

(54) PETROLEUM PROCESSING METHOD

(75) Inventors: Makoto Inomata, Yokohama; Toshiya Okumura, Handa; Shigeki Nagamatsu, Yokohama, all of (JP)

(73) Assignee: JGC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/150,531

(22) Filed: Sep. 10, 1998

(30) Foreign Application Priority Data

Sep. 11, 1997 (JP) ..... 9-247119

(51) Int. Cl.[7] ..... C10G 48/05

(52) U.S. Cl. ..... 208/210; 208/211; 208/212; 208/213; 208/299; 208/301; 208/89; 208/22; 208/92; 208/57; 208/58; 208/59

(58) Field of Search ..... 208/210, 211, 208/212, 213, 299, 301, 89, 22, 92, 57, 58, 59

(56) References Cited

U.S. PATENT DOCUMENTS

| | | | | | |
|---|---|---|---|---|---|
| 2,889,272 | A | * | 6/1959 | Moy et al. | 208/210 |
| 3,017,345 | A | * | 1/1962 | Eastman et al. | 208/210 |
| 3,147,210 | A | * | 9/1964 | Hass et al. | 208/210 |
| 3,155,608 | A | * | 11/1964 | Hopper et al. | 208/251 |
| 3,180,820 | A | * | 4/1965 | Gleim et al. | 208/211 |
| 3,183,179 | A | * | 5/1965 | Schuman | 208/97 |
| 3,193,495 | A | | 7/1965 | Ellor | 208/211 |
| 3,392,112 | A | * | 7/1968 | Bercik et al. | 208/210 |
| 3,429,801 | A | * | 2/1969 | Gleim et al. | 208/58 |
| 3,841,998 | A | * | 10/1974 | Bertolacini et al. | 208/89 |
| 4,155,835 | A | | 5/1979 | Antal | 208/89 |
| 4,686,030 | A | * | 8/1987 | Ward | 208/216 PP |
| 4,849,093 | A | * | 7/1989 | Vauk et al. | 208/143 |
| 5,316,658 | A | * | 5/1994 | Ushio et al. | 208/216 R |
| 5,770,046 | A | * | 6/1998 | Sudhakar | 208/216 R |

FOREIGN PATENT DOCUMENTS

| | | | |
|---|---|---|---|
| EP | 0635555 | * | 1/1995 |
| JP | 0308679 3 A | | 4/1991 |
| JP | 0507867 0 A | | 3/1993 |
| JP | 0708257 3 A | | 3/1995 |

* cited by examiner

*Primary Examiner*—Nadine Preisch
(74) *Attorney, Agent, or Firm*—Webb Ziesenheim Logsdon Orkin & Hanson, P.C.

(57) ABSTRACT

A petroleum processing method comprising the steps of: performing an atmospheric distillation of crude oil; collectively hydrodesulfurizing the resultant distillates consisting of gas oil and fractions whose boiling point is lower than that of gas oil in a reactor in the presence of a hydrogenation catalyst at 310 to 370° C. under 30 to 70 kg/cm$^2$G (first hydrogenation step); and further performing hydrodesulfurization at lower temperatures (second hydrogenation step). When the second hydrogenation step is carried out only for the heavy naphtha obtained by separating the distillates after the first hydrogenation step, the second hydrogenation temperature can be in the range of 250 to 400° C.

7 Claims, 5 Drawing Sheets

Crude oil
1a
1
1h
1g
1f
1e
1d
1c
1b
Bottoms
10
H2
2a
2
2b
2c
7b
7a
7
7c
5b
5a
5
5d (2b)
H2S
Light gas
LPG
6a
6
6b
6c
4d
4c
4
4b
4g
4f
4a
Light naphtha
Heavy naphtha
Kerosene
Gas oil
H2
3a
3
3b
8
8a
Catalytic reforming unit

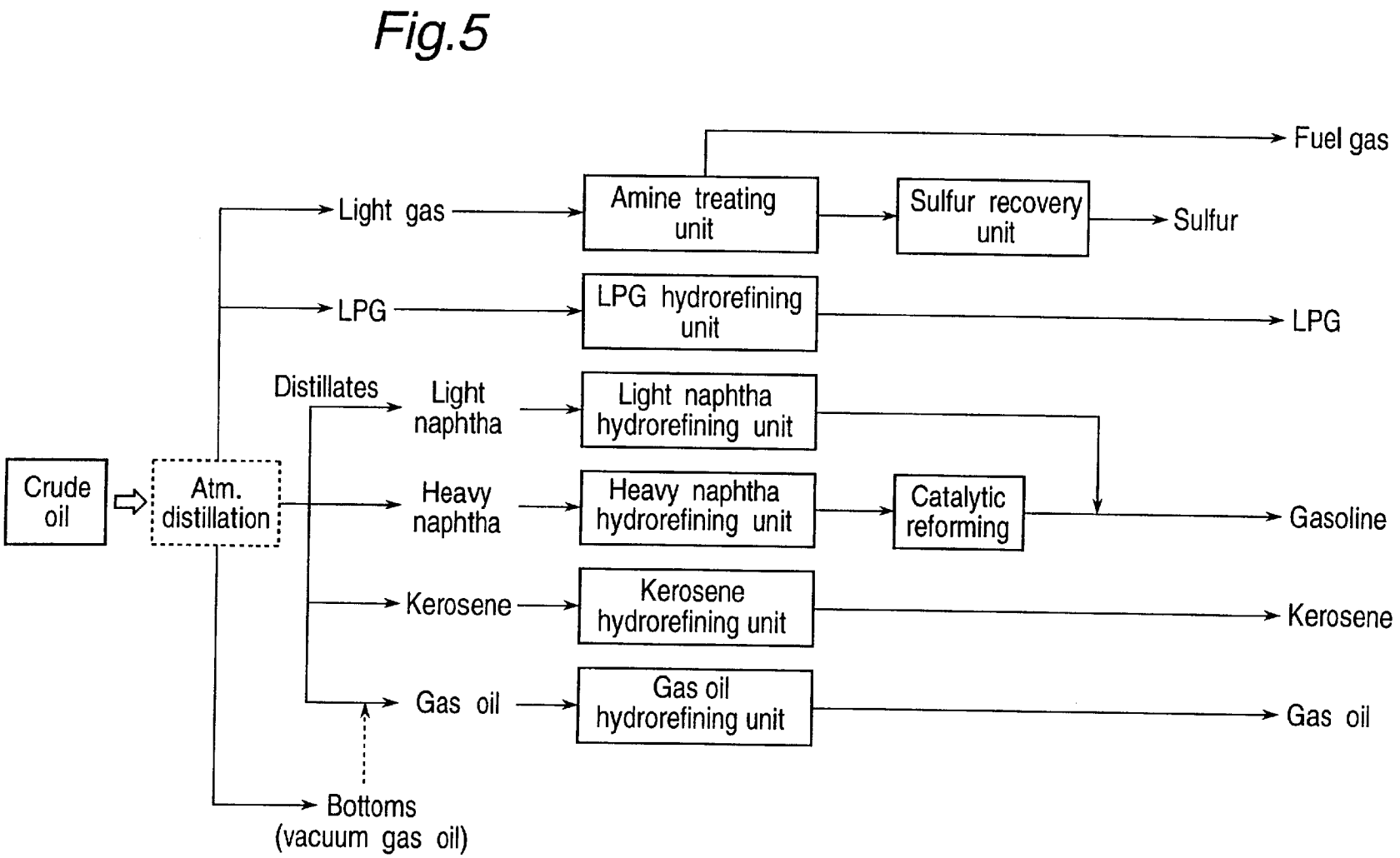
Fig.5
Crude oil
Atm. distillation
Light gas
LPG
Distillates
Light naphtha
Heavy naphtha
Kerosene
Gas oil
Bottoms (vacuum gas oil)
Amine treating unit
LPG hydrorefining unit
Light naphtha hydrorefining unit
Heavy naphtha hydrorefining unit
Kerosene hydrorefining unit
Gas oil hydrorefining unit
Sulfur recovery unit
Catalytic reforming
Fuel gas
Sulfur
LPG
Gasoline
Kerosene
Gas oil

PETROLEUM PROCESSING METHOD

FIELD OF THE INVENTION

The present invention relates to the separation and purification of crude oil by means of a simplified apparatus and relates to an apparatus suitable for carrying out the above petroleum processing.

BACKGROUND OF THE INVENTION

In the art of oil refining, it is common practice to perform an atmospheric distillation of crude oil having undergone pretreatments such as dehydration and desalting so that the crude oil is separated into bottoms and fractions of gas oil, kerosene, heavy naphtha, light naphtha, LP gas and light gas and to carry out hydrorefining for each of fractions to be subjected to hydrorefining, optionally followed by reforming. Thus, petroleum products are obtained. For example, referring to FIG. 5, the light gas (off gas) fraction among the fractions separated by an atmospheric distillation of crude oil has acid gases such as $H_2S$ separated by an amine treatment unit and is outputted as fuel gas. Among the above fractions, the LP gas fraction has its impurities removed by an LP gas treatment unit and is outputted as LP gas. Sulfur is recovered from the acid gases.

The light naphtha fraction undergoes treatment such as sweetening by a light naphtha treatment unit to thereby remove mercaptan, $H_2S$, etc. and is formulated into gasoline. The heavy naphtha fraction undergoes a hydrorefining by a heavy naphtha treatment unit and, thereafter, a catalytic reforming and is outputted as gasoline. In the use of the heavy naphtha in the catalytic reforming, the sulfur content of the heavy naphtha must not exceed 1 ppm by weight. Thus, sulfur components such as mercaptan, undesulfurized sulfides and hydrogen sulfide ($H_2S$) contained in the above hydrorefined heavy naphtha are removed by treating with an adsorbent of a metal oxide such as NiO, CuO or ZnO or by an amine absorption.

The kerosene and gas oil fractions are each individually hydrogenated, optionally followed by treatment with the use of, for example, an adsorbent, and outputted as kerosene and gas oil, respectively.

The atmospheric distillation bottoms are distilled at reduced pressure with the use of a vacuum distiller, and the thus obtained vacuum distillates are used as a feedstock for producing gas oil.

As is apparent from the above, in conventional oil refining, the individual fractions such as light naphtha, heavy naphtha, kerosene and gas oil are purified by the respective treatment units such as a hydrorefining unit. Therefore, problems are encountered such that the constitution of the petroleum processing apparatus is complex and such that not only are complicated and large facilities required but also construction cost is high.

Further, in conventional oil refining, it is conducted in unified form irrespective of the amount of processed crude oil. In this connection, it is desireable to simplify the petroleum processing apparatus and reduce the scale thereof to thereby lower oil refinery cost especially when the amount of processed crude oil is small.

In view of the above prior art, the applicant proposed a method comprising performing an atmospheric distillation of crude oil so that the crude oil is separated into bottoms and distillates and collectively hydrogenating the distillates in a reactor and an apparatus suitable for use in the method (see Japanese Patent Laid-open Publication No. 7(1995)-82573). In this method, the distillates are collectively hydrorefined and, thereafter, fractionated into individual fractions. This method enables simplifying the petroleum processing apparatus as compared with the prior art in which the respective hydrorefining reactors are employed for individual fractions. This method is useful especially when the amount of processed crude oil is small.

In the hydrodesulfurization of gas oil fraction containing sparingly desulfurizable sulfur compounds among the distillates obtained by the above atmospheric distillation of crude oil, the higher the desulfurization temperature, the higher the desulfurization efficiency. Thus, when the above distillates are mixed and collectively hydrogenated, it is necessary to select conditions under which gas oil can efficiently be desulfurized. However, when the hydrogenation temperature is 340° C. or higher, sulfur components such as $H_2S$ having been removed by the hydrogenation reaction are likely to undergo a recombination reaction with olefin (naphtha fraction). When the catalyst life is close to an end (EOR: end of run), the hydrogenation reaction must be carried out at high temperature, thereby increasing the likelihood of recombination reaction.

When the sulfur content of light naphtha or heavy naphtha is increased by the above recombination, a new problem occurs such that the sulfur content of hydrogenated naphtha, especially, heavy naphtha may exceed the tolerance set for a feedstock for catalytic reforming.

When the collective hydrogenation of the distillates is performed at relatively low temperature for avoiding this problem, there occurs another problem such that the desulfurization efficiency is lowered with the result that only gas oil with a high sulfur content can be obtained.

The inventor has conducted investigations with a view toward solving the above problems once and for all. As a result, it has been found that the above object can be attained by performing the collective hydrogenation of distillates in two stages, i.e., the first stage comprising performing the hydrogenation at high temperature so that the desulfurization efficiency of gas oil is high and the second stage comprising performing the hydrogenation at low temperature so that the possibility of sulfur components such as hydrogen sulfide formed by the first-stage hydrogenation undergoing a recombination with olefin is very low. Further, it has been found that the above object can also be attained by separating hydrogenated oil which has been obtained by the first-stage hydrogenation and by subjecting only thus obtained heavy naphtha fraction to the second-stage hydrogenation, followed by an adsorption removal. The present invention has been completed on the basis of the above findings.

The diesel gas oil hydrogenating method in which the hydrogenation of gas oil is performed in two stages, i.e., the first stage comprising hydrogenating gas oil to thereby effect the desulfurization thereof and the second stage comprising hydrogenating the gas oil having been colored by the first-stage desulfurization so as to improve the hue thereof is known in the art.

For example, Japanese Patent Laid-open Publication No. 5(1993)-78670 describes the method in which diesel gas oil (petroleum distillate with a boiling point of 150 to 400° C.) is hydrogenated at temperature as high as 375 to 450° C. under a pressure of 45 to 100 kg/cm$^2$ to thereby effect a desulfurization to a sulfur content of 0.05% by weight or below (first stage) and, thereafter, hydrogenating the gas oil at 200 to 300° C. under a pressure of 45 to 100 kg/cm$^2$ (second stage) so that the hue of the diesel gas oil having been colored by the first-stage hydrogenation is improved. Although the hue is improved to at least −10 in terms of Saybolt chronometry value in the second-stage hydrogenation, it is described in the Example portion of the literature that the sulfur content of the gas oil after the second-stage hydrogenation is the same as that of the gas oil after the first-stage hydrogenation, so that no desulfurizing effect is exerted in the second-stage hydrogenation. Furthermore, Japanese Patent Laid-open Publication No. 3(1991)-86793 proposed the similar method comprising desulfurizing gas oil (first stage) and performing a second-stage hydrogenation for improving the hue thereof (second stage). As in the above literature, it is described in the Example portion that no desulfurizing effect is exerted in the second-stage hydrogenation.

OBJECT OF THE INVENTION

It is an object of the present invention to provide a petroleum processing method which enables the efficient separation and purification of crude oil by means of a simplified apparatus and to provide an apparatus suitable for carrying out the above petroleum processing.

SUMMARY OF THE INVENTION

The petroleum processing method of the present invention comprises the steps of:

- performing an atmospheric distillation of crude oil so that the crude oil is separated into bottoms and distillates, these distillates comprising gas oil and fractions whose boiling point is lower than that of gas oil;
- collectively hydrodesulfurizing the distillates in a reactor in the presence of a hydrogenation catalyst at 310 to 370° C. under 30 to 70 kg/cm$^2$G (first hydrogenation step); and
- further collectively hydrodesulfurizing the above hydrodesulfurized distillates in a reactor in the presence of a hydrogenation catalyst at 280 to 330° C. under 30 to 70 kg/cm$^2$G (second hydrogenation step).

In this method, the second hydrogenation step is generally followed by the steps of:

- separating gas fractions from the hydrodesulfurized distillates (gas separating step); and
- separating the distillates having undergone the gas separating step into gas oil, kerosene, heavy naphtha and light naphtha fractions (fractionation step).

The heavy naphtha fraction obtained in the fractionation step can be catalytically reformed to thereby obtain gasoline. Generally, the heavy naphtha fraction has a sulfur content of not greater than 1 ppm by weight.

Alternatively, the petroleum processing method of the present invention may comprise the above crude oil atmospheric distillation step and first hydrogenation step followed by the steps of:

- separating gas fractions from the distillates hydrodesulfurized in the first hydrogenation step (gas separating step);
- separating the distillates having undergone the gas separating step into gas oil, kerosene, heavy naphtha and light naphtha fractions (fractionation step); hydrodesulfurizing the heavy naphtha fraction obtained in the fractionation step in the presence of a hydrogenation catalyst at 250 to 400° C. under 3 to 30 kg/cm$^2$G (second hydrogenation step); and
- removing by adsorption sulfur components from the heavy naphtha fraction hydrodesulfurized by the second hydrogenation step (adsorption step).

In this method in which the fractionation step is carried out after the first hydrogenation step, the possibility of hydrogen sulfide undergoing a recombination reaction with olefin is very low in the second hydrogenation step conducted for the heavy naphtha. Thus, the second hydrogenation can be performed at higher temperatures than in the first hydrogenation step. The heavy naphtha fraction obtained in the adsorption step can be catalytically reformed to thereby obtain gasoline.

The petroleum processing apparatus of the present invention comprises:

- an atmospheric distillation unit capable of performing an atmospheric distillation of crude oil so that the crude oil is separated into bottoms and distillates, said distillates comprising gas oil and fractions whose boiling point is lower than that of gas oil;
- a first hydrogenation reactor capable of collectively hydrodesulfurizing the distillates separated by the atmospheric distillation unit; and
- a second hydrogenation reactor capable of further collectively hydrodesulfurizing the distillates hydrodesulfurized by the first hydrogenation reactor.

This petroleum processing apparatus, generally further to the atmospheric distillation unit, the first hydrogenation reactor and the second hydrogenation reactor, comprises:

- means for separating gas fractions from the distillates hydrodesulfurized by the second hydrogenation reactor; and
- fractionating means for separating the distillates processed by the gas separating means into gas oil, kerosene, heavy naphtha and light naphtha fractions.

This petroleum processing apparatus may further comprise a catalytic reformer capable of catalytically reforming the heavy naphtha fraction separated by the fractionating means.

Alternatively, the petroleum processing apparatus of the present invention may comprise:

- the above atmospheric distillation unit and first hydrogenation reactor;
- means for separating gas fractions from the distillates hydrodesulfurized by the first hydrogenation reactor;
- fractionating means for separating the distillates processed by the gas separating means into gas oil, kerosene, heavy naphtha and light naphtha fractions;
- a second hydrogenation reactor capable of hydrodesulfurizing the heavy naphtha fraction separated by the fractionating means; and
- an adsorber capable of removing by adsorption sulfur components from the heavy naphtha fraction hydrodesulfurized by the second hydrogenation reactor.

This petroleum processing apparatus may further comprise a catalytic reformer capable of catalytically reforming the heavy naphtha fraction processed by the adsorber.

BRIEF DESCRIPTION OF THE DRAWING

FIG. 5 is a diagram showing the process flow of the conventional petroleum processing method.

DETAILED DESCRIPTION OF THE INVENTION

The petroleum processing method and petroleum processing apparatus according to the present invention will be described in detail below.

Petroleum Processing Method

The petroleum processing method (i) of the present invention comprises the steps of:

performing an atmospheric distillation of crude oil so that the crude oil is separated into bottoms and distillates, these distillates consisting of gas oil and fractions whose boiling point is lower than that of gas oil;

collectively hydrodesulfurizing the distillates in a reactor in the presence of a hydrogenation catalyst at 310 to 370° C. under 30 to 70 kg/cm$^2$G (first hydrogenation step); and further collectively hydrogenating and desulfurizing the above hydrogenated and desulfurized distillates in a reactor in the presence of a hydrogenation catalyst at 280 to 330° C. under 30 to 70 kg/cm$^2$G (second hydrogenation step).

Figure 1:
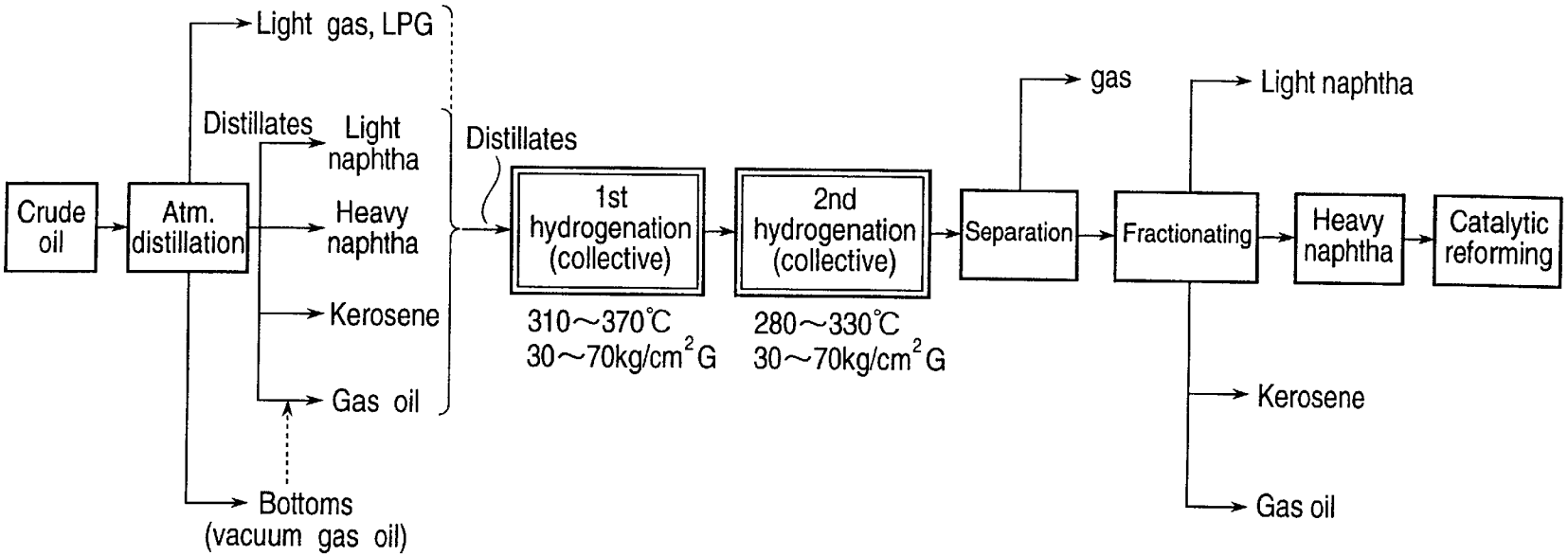
FIG. 1 is a diagram showing the process flow of the petroleum processing method (i) of the present invention.

FIG. 1 schematically shows the process flow of the above petroleum processing method (i).

In the crude oil distillation step, generally, base sediment and water are first removed from the crude oil, and pretreatments such as dehydration and desalting are conducted. The resultant crude oil is subjected to an atmospheric distillation so that the crude oil is separated into bottoms and distillates, these distillates consisting of gas oil and fractions whose boiling point is lower than that of gas oil.

The distillates consisting of gas oil and fractions whose boiling point is lower than that of gas oil are, generally, fractions with a boiling point of −40° C. to +400° C. which, specifically, consist of gas oil, kerosene, heavy naphtha, light naphtha, LP gas (LPG) and light gas. In the distillation, either the individual fractions may be obtained separately or the distillates consisting of gas oil and fractions whose boiling point is lower than that of gas oil, exclusive of bottoms, may be obtained in the form of one fraction. Alternatively, the distillates consisting of gas oil and fractions whose boiling point is lower than that of gas oil, exclusive of distillates whose hydrogenation is not required (for example, light gas and LPG), can be obtained in the form of one fraction. The fractions having been individually separated by the distillation are mixed together and collectively hydrogenated.

In the present invention, in the subsequent hydrodesulfurization of the above distillates, it is requisite that distillates whose hydrogenation is required be collectively subjected to the hydrogenation step but the distillates to be subjected to the hydrogenation step may contain or may not contain distillates whose hydrogenation is not needed.

Vacuum gas oil obtained by a vacuum distillation of the bottoms produced by the atmospheric distillation of crude oil may be added to the distillates to be subjected to the hydrogenation step.

In the petroleum processing method (i) of the present invention, the distillates (consisting of gas oil and fractions whose boiling point is lower than that of gas oil) obtained by the atmospheric distillation of crude oil are collectively processed by the two-stage hydrogenation.

For example, a gas-liquid downstream parallel flow reactor, a gas-liquid counterflow reactor and a gas-liquid upstream parallel flow reactor can be mentioned as the reactor suitable for use in the hydrogenation step of the present invention.

In the first hydrogenation step, a wide variety of conventional hydrogenation catalysts can be used as the hydrogenation catalyst. For example, use can be made of Co—Mo, Ni—Mo, Ni—Co—Mo and Ni—W catalysts. These active metals are preferably borne on a support such as alumina.

In the first hydrogenation step, the above distillates are collectively hydrodesulfurized in a reactor in the presence of a hydrogenation catalyst at 310 to 370° C., preferably, 330 to 370° C., still preferably, 330 to 350° C. under 30 to 70 kg/cm$^2$G, preferably, 40 to 60 kg/cm$^2$G.

In the first hydrogenation step, it is preferred that the $H_2$/oil (NL/L) ratio range from 60 to 150, especially, from 70 to 120 and that the liquid space velocity (LHSV) range from 1 to 5 hr$^{-1}$, especially, from 1.5 to 3 hr$^{-1}$.

The sulfur content of the gas oil fraction can be reduced to 0.2% by weight or less, preferably, 0.05% by weight or less by this first hydrogenation step.

Although the same hydrogenation catalysts as in the first hydrogenation step can be used in the second hydrogenation step, preferred use is made of catalysts with high hydrogenation capability which are especially active to induce the hydrodesulfurization of mercaptan. For example, Ni—Mo, Ni—Co—Mo and Ni—W catalysts can preferably be used.

In the second hydrogenation step, the above distillates are further collectively hydrogenated and desulfurized in a reactor in the presence of a hydrogenation catalyst at 280 to 330° C., preferably, 300 to 320° C. under 30 to 70 kg/cm$^2$G, preferably, 30 to 60 kg/cm$^2$G.

From the viewpoint of operation easiness, the second hydrogenation step is preferably conducted under the same pressure as in the first hydrogenation step. In the second hydrogenation step, it is preferred that the $H_2$/oil (NL/L) ratio range from 60 to 150, especially, from 70 to 120 and that the liquid space velocity (LHSV) range from 3 to 10 hr$^{-1}$, especially, from 5 to 8 hr$^{-1}$.

In the above petroleum processing method (i) in which the distillates obtained by the atmospheric distillation of crude oil are collectively hydrodesulfurized in two stages, the second hydrogenation step is performed at a temperature lower than in the first hydrogenation step. That is, the desulfurization of sparingly desulfurizable fraction such as gas oil is efficiently carried out in the first hydrogenation step in which the temperature is relatively high. Even if a recombination reaction occurs between sulfur components and olefin during the desulfurization, the sulfur components can be efficiently removed as $H_2S$, etc. in the second hydrogenation step conducted at low temperature.

In the above petroleum processing method (i), desulfurized fractions can be obtained by performing, subsequent to the second hydrogenation step, the steps of:

separating gas fractions from the hydrodesulfurized distillates (gas separating step); and separating the distillates having undergone the gas separating step into gas oil, kerosene, heavy naphtha and light naphtha fractions (fractionation step). Gas fractions remaining in the distillates after the gas separating step can be separated from the other fractions in the fractionation step.

For example, the distillates having been hydrodesulfurized in the second hydrogenation step are led into a gas-liquid separator in which the distillates are separated into purified oil and gas (hydrogen, product gas, etc.). The separated purified oil is introduced into a stripper to thereby remove gas fractions (product gases such as LPG, light gas and $H_2S$) remaining in the oil. After the gas removal, the purified oil is subjected to the fractionation step in which the purified oil can be separated into fractions by, for example, distillation. The hydrogen containing gas having been separated by, for example, a gas-liquid separator in the gas separating step can be circulated to the first hydrogenation step and/or the second hydrogenation step.

The gas oil having been separated in the fractionation step can be returned according to necessity to the first hydrogenation step and/or the second hydrogenation step so that the gas oil is hydrodesulfurized once more.

In the present invention, the heavy naphtha obtained by the fractionation step can be catalytically reformed into gasoline. Prior to the catalytic reforming, the heavy naphtha can be subjected to adsorption treatment in which use can be made of an $H_2S$ adsorber such as ZnO.

The sulfur content of the heavy naphtha to be subjected to the above catalytic reforming is generally lowered to 1 ppm by weight or less. Common processes such as the UOP platforming method in which, for example, Pt—$Al_2O_3$ catalyst is used, the IFP catalytic reforming method and the power forming method can be employed in the catalytic reforming.

The petroleum processing method (ii) of the present invention will now be described. This petroleum processing method comprises the above crude oil atmospheric distillation step and first hydrogenation step followed by the steps of:

- separating gas fractions from the distillates hydrodesulfurized in the first hydrogenation step (gas separating step);
- separating the distillates having undergone the gas separating step into gas oil, kerosene, heavy naphtha and light naphtha fractions (fractionation step);
- hydrodesulfurizing the heavy naphtha fraction obtained in the fractionation step in the presence of a hydrogenation catalyst (second hydrogenation step); and
- removing by adsorption sulfur components from the heavy naphtha fraction hydrodesulfurized by the second hydrogenation step (adsorption step).

Figure 2:
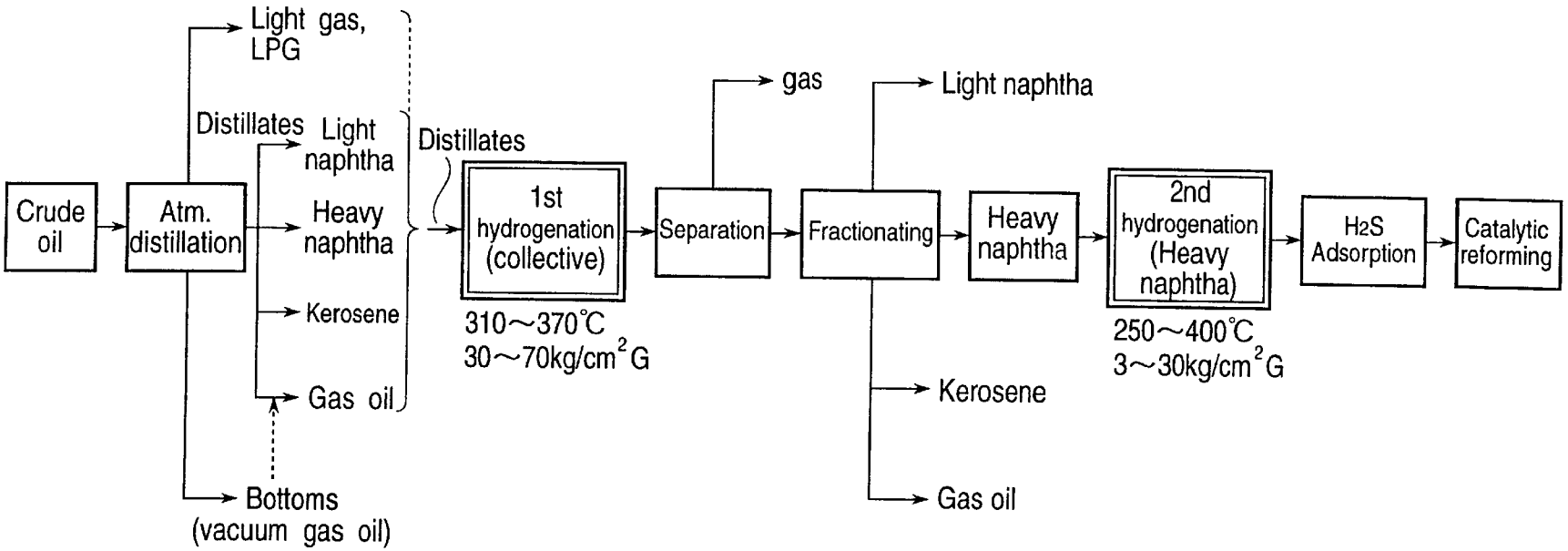
FIG. 2 is a diagram showing the process flow of the petroleum processing method (ii) of the present invention.

FIG. 2 schematically shows the process flow of the above petroleum processing method (ii).

In the petroleum processing method (ii) of the present invention, the same first hydrogenation step as in the petroleum processing method (i) is carried out, and the same gas separating step and fractionation step as in the petroleum processing method (i) are carried out prior to the second hydrogenation step. The second hydrogenation step is carried out for the heavy naphtha obtained by the fractionation step. In the gas separating step, for example, a hydrogen containing gas separated by a gas-liquid separator or a stripper can be circulated to the first hydrogenation step and/or the second hydrogenation step.

In this petroleum processing method (ii), the second hydrogenation step can be performed at temperature higher than in the first hydrogenation step. For example, in the second hydrogenation step, the separated heavy naphtha is hydrodesulfurized at 250 to 400° C., preferably, 300 to 370° C. under 3 to 30 kg/cm$^2$G, preferably, 10 to 20 kg/cm$^2$G.

In the second hydrogenation step, it is preferred that the $H_2$/oil (NL/L) ratio range from 30 to 80, especially, from 40 to 60 and that the LHSV range from 5 to 12 hr$^{-1}$, especially, from 7 to 10 hr$^{-1}$.

In the petroleum processing method (ii), the adsorption step is performed subsequent to the second hydrogenation step, so that sulfur components are removed by adsorption from the heavy naphtha obtained by the second hydrogenation step.

In this adsorption removal of sulfur components, use can be made of an $H_2S$ adsorber such as ZnO. Although the adsorption removal step can be conducted at the same temperature and under the same pressure as in the above second hydrogenation step, it is generally preferred that the LHSV range from 0.5 to 5 hr$^{-1}$, especially, from 2 to 4 hr$^{-1}$.

The heavy naphtha obtained by the above adsorption step is satisfactorily freed of sulfur components and can be catalytically reformed into gasoline. The sulfur content of the heavy naphtha to be subjected to the catalytic reforming is generally up to 1 ppm by weight.

In the petroleum processing methods (i) and (ii), hydrogen containing gases whose hydrogen concentration is at least about 60% can be used as hydrogen source. Examples of such hydrogen sources include the hydrogen formed as a by-product in a heavy naphtha catalytically reforming device and the hydrogen containing gas separated by the above gas-liquid separator.

The above petroleum processing methods of the present invention enable collectively and efficiently performing the hydrodesulfurization purification, which is commonly carried out individually for each of gas oil, kerosene, heavy naphtha and light naphtha fractions in the art. Further, the petroleum processing methods enable satisfactorily reducing the sulfur content of obtained individual fractions, especially, heavy naphtha and enable simplifying the oil refining equipment. Thus, oil refining equipment cost and running cost can be reduced.

Petroleum Processing Apparatus

Figure 3:
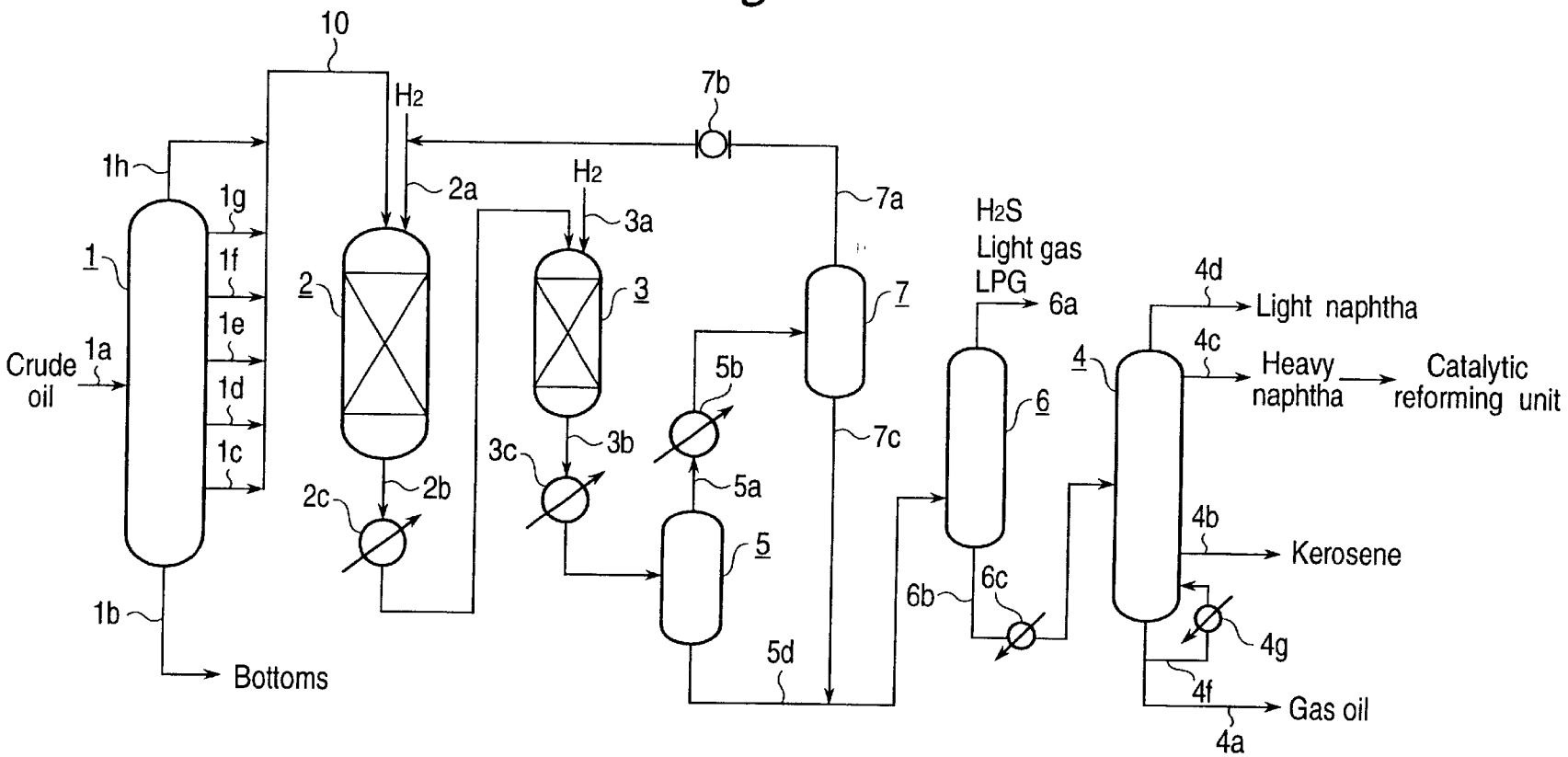
FIG. 3 is a view showing a form of the petroleum processing apparatus (i) of the present invention.

The petroleum processing apparatus (i) of the present invention is an apparatus for performing the above petroleum processing method (i). Referring to FIG. 3, the petroleum processing apparatus (i) comprises:

- atmospheric distillation unit 1 capable of performing an atmospheric distillation of crude oil so that the crude oil is separated into bottoms and distillates, these distillates comprising gas oil and fractions whose boiling point is lower than that of gas oil;
- first hydrogenation reactor 2 capable of collectively hydrodesulfurizing the distillates separated by the atmospheric distillation unit 1; and
- second hydrogenation reactor 3 capable of further collectively hydrodesulfurizing the distillates hydrodesulfurized by the first hydrogenation reactor 2.

The atmospheric distillation unit 1 is furnished with crude oil feeding line 1*a*, bottoms withdrawing line 1*b* and line 10 for introducing the distillation fractions into the first hydrogenation reactor 2. The distillation fraction introducing line 10 may be a single line adapted to withdraw as one fraction the distillates comprising gas oil and fractions whose boiling point is lower than that of gas oil from the atmospheric distillation unit 1. Alternatively, the distillation fraction introducing line 10 may be a single line adapted to withdraw as one fraction the distillates comprising gas oil and fractions whose boiling point is lower than that of gas oil, from which the LPG and light gas not requiring hydrogenation have been removed. Still alternatively, the distillation fraction introducing line 10 may be a line comprising a combination of distillation unit gas oil withdrawing line 1*c*, kerosene withdrawing line 1*d*, heavy naphtha withdrawing line 1*e*, light naphtha withdrawing line 1*f*, LPG withdrawing line 1*g* and light gas withdrawing line 1*h*.

The first hydrogenation reactor 2 is furnished with hydrogen feeding line 2*a* and line 2*b* adapted to introduce the fraction hydrodesulfurized in the first hydrogenation reactor 2 into the second hydrogenation reactor 3.

The second hydrogenation reactor 3 is furnished with hydrogen feeding line 3*a* and distillate withdrawing line 3*b*.

The hydrogen supply to each of the hydrogenation reactors can be separately performed as shown. Alternatively, it can be performed by collectively feeding hydrogen in an amount matching the sum of the amounts required by the first hydrogenation reactor 2 and the second hydrogenation reactor 3 into the first hydrogenation reactor 2 through the hydrogen feeding line 2*a* and by feeding hydrogen into the second hydrogenation reactor 3 through the line 2*b*. In this construction, the hydrogen feeding line 3*a* is not needed.

For example, a gas-liquid downstream parallel flow reactor, a gas-liquid counterflow reactor or a gas-liquid upstream parallel flow reactor can be used as the first hydrogenation reactor 2 or second hydrogenation reactor 3 for use in the hydrogenation step of the present invention.

The petroleum processing apparatus (i) of the present invention, generally further to the atmospheric distillation unit FIGS. 1, the first hydrogenation reactor 2 and the second hydrogenation reactor 3, comprises:

means for separating gas fractions, such as hydrogen, LPG, light gas and other product gas, from the distillates hydrodesulfurized by the second hydrogenation reactor 2; and fractionating means for separating the distillates freed of the gas fractions into gas oil, kerosene, heavy naphtha and light naphtha fractions.

For example, a gas-liquid separator or a stripper can be mentioned as the means for separating the gas fractions from the distillates. For example, the distillates having been withdrawn from the second hydrogenation reactor 3 through the line 3*b* are passed through gas-liquid separator 5 and stripper 6 as the gas separating means and fed into fraction separating means (e.g., distillation column) 4. The fraction separating means 4 separates the distillates into gas oil, kerosene, heavy naphtha and light naphtha fractions. The gas fractions such as LPG and light gas which remain in the distillates having been processed by the stripper 6 can also be separated by the distillation column 4.

This mode of the invention will be described in greater detail. The line 2*b* of the first hydrogenation reactor 2 is generally connected through cooler 2*c* to the second hydrogenation reactor 3. The distillate withdrawing line 3*b* of the second hydrogenation reactor 3 is generally connected through cooler 3*c* to the gas-liquid separator 5.

This petroleum processing apparatus may be furnished with line 5*a* which leads the gas phase separated by the gas-liquid separator 5, through cooler 5*b*, to gas-liquid separator 7, line 7*a* which circulates the gas phase separated by the gas-liquid separator 7, through compressor 7*b*, to the hydrogen feeding line 2*a*, and line 7*c* which leads the liquid phase separated by the gas-liquid separator 7 to liquid phase withdrawing line 5*d* of the gas-liquid separator 5. The line 7*a* of the gas-liquid separator 7 may be fitted with an amine treatment device (not shown) capable of separating and removing $H_2S$ and other product gas from the gas phase before the introduction of the gas phase into the compressor 7*b*.

The liquid phase withdrawing line 5*d* of the gas-liquid separator 5 is connected to the stripper 6. Gas fractions such as $H_2S$, LPG and light gas are withdrawn through line 6*a* from the stripper 6. Liquid phase is fed through line 6*b* into the distillation column 4. The liquid phase withdrawing line 6*b* of the stripper 6 may be fitted with heater 6*c*.

The distillation column 4 is furnished with gas oil line 4*a*, kerosene line 4*b*, heavy naphtha line 4*c* and light naphtha line 4*d* for withdrawing separated fractions.

The line 4*a* of the distillation column 4 may be fitted with line 4*f* for circulating gas oil through heater 4*g* to the distillation column 4.

The petroleum processing apparatus (i) may be furnished with, in addition to the distillation column 4, a catalytic reforming unit (not shown) capable of catalytically reforming the heavy naphtha separated by the distillation column 4 into gasoline.

The catalytic reforming unit which has heavy naphtha fed through the heavy naphtha line 4*c* and converts it to gasoline is generally furnished with a gas-liquid separator (not shown). The catalytic reforming unit may be furnished with a line for withdrawing gasoline through the gas-liquid separator and a line (not shown) for subjecting hydrogen formed as by-product in the catalytic reforming unit to gas-liquid separation and circulating the resultant hydrogen to the first hydrogenation reactor 2 and/or second hydrogenation reactor 3.

Figure 4:
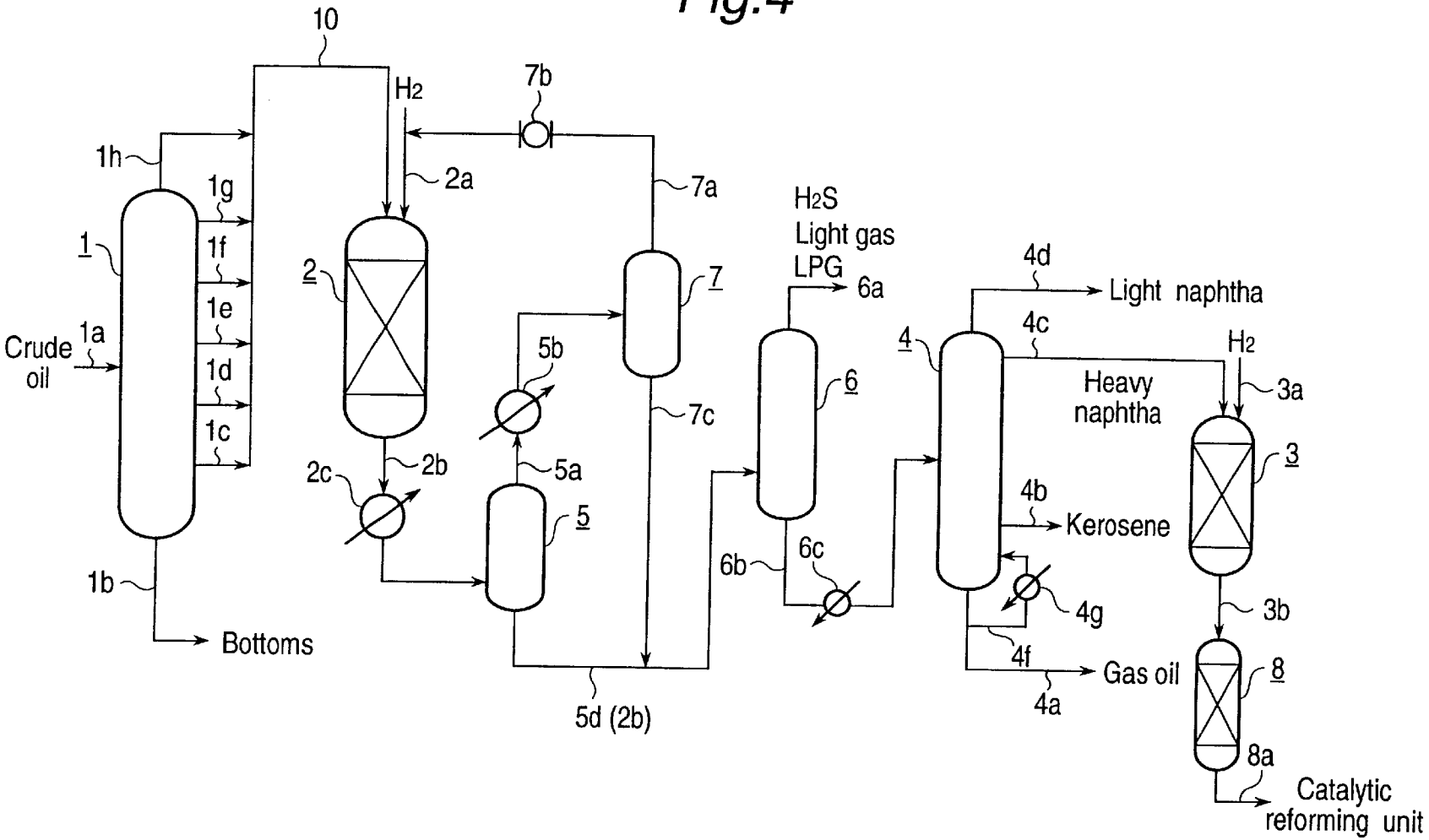
FIG. 4 is a view showing a form of the petroleum processing apparatus (ii) of the present invention.

The petroleum processing apparatus (ii) of the present invention is an apparatus for performing the above petroleum processing method (ii). Referring to FIG. 4, the petroleum processing apparatus (ii) comprises:

atmospheric distillation unit 1 capable of performing an atmospheric distillation of crude oil so that the crude oil is separated into bottoms and distillates, these distillates comprising gas oil and fractions whose boiling point is lower than that of gas oil;

first hydrogenation reactor 2 capable of collectively hydrodesulfurizing the distillates separated by the atmospheric distillation unit 1;

means for separating gas fractions from the distillates hydrodesulfurized by the first hydrogenation reactor 2 (for example, means comprising gas-liquid separator 5 and stripper 6 capable of removing gas fractions from the distillates withdrawn from the gas-liquid separator 5);

fractionating means (e.g., distillation column) 4 for separating the distillates processed by the gas separating means into, mainly, gas oil, kerosene, heavy naphtha and light naphtha fractions;

second hydrogenation reactor 3 capable of hydrodesulfurizing the heavy naphtha fraction separated by the fractionating means 4; and adsorber 8 capable of removing by adsorption sulfur components from the heavy naphtha fraction hydrodesulfurized by the second hydrogenation reactor.

The first hydrogenation reactor 2 is fitted with hydrogen feeding line 2*a* and line 2*b* for withdrawing the distillates hydrogenated and desulfurized in the first hydrogenation reactor 2.

Through 3 and 4, like reference characters are used to designate like parts or members, and repetition of the description is avoided.

In this mode of the invention, the line 2*b* of the first hydrogenation reactor 2 is generally connected through cooler 2*c* to the gas-liquid separator 5. This petroleum processing apparatus may be furnished with line 5*a* which leads the gas phase separated by the gas-liquid separator 5, through cooler 5*b*, to gas-liquid separator 7, line 7*a* which circulates the gas phase separated by the gas-liquid separator 7, through compressor 7*b*, to the hydrogen feeding line 2*a*, and line 7*c* which leads the liquid phase separated by the gas-liquid separator 7 to liquid phase withdrawing line 5*d* of the gas-liquid separator 5. The line 7*a* of the gas-liquid separator 7 may be fitted with an amine treatment device (not shown) capable of separating and removing $H_2S$ and other product gas from the gas phase before the introduction of the gas phase into the compressor 7*b*.

Gas fractions such as $H_2S$, LPG and light gas are withdrawn through line 6*a* from the stripper 6. Liquid phase is fed through line 6*b* into the distillation column 4.

The line 6*b* for withdrawing the liquid phase from the stripper 6 may be fitted with heater 6*c* for heating the distillates as in the petroleum processing apparatus (i). The distillation column 4 may be fitted with line 4*f* for circulating gas oil through heater 4*g* to the distillation column 4.

The distillation column 4 is furnished with gas oil line 4*a*, kerosene line 4*b*, heavy naphtha line 4*c* and light naphtha line 4*d* for withdrawing separated fractions. The heavy naphtha line 4*c* is connected to the second hydrogenation reactor 3.

The heavy naphtha line 4*c* of the distillation column 4 is preferably connected through a heating furnace of a heavy naphtha catalytically reforming unit (not shown) to the second hydrogenation reactor 3.

The heavy naphtha hydrodesulfurized in the second hydrogenation reactor 3 is withdrawn through line 3*b* and fed into adsorber 8.

The petroleum processing apparatus (ii) may be furnished with a catalytic reforming unit (not shown) capable of catalytically reforming the heavy naphtha having been subjected to adsorption in the adsorber 8 and withdrawn through line 8*a* to thereby obtain gasoline. This catalytic reforming unit is generally furnished with a gas-liquid separator (not shown). The catalytic reforming unit may further be furnished with a line for withdrawing gasoline through the gas-liquid separator and a line (not shown) for subjecting hydrogen formed as by-product in the catalytic reforming unit to gas-liquid separation and circulating the resultant hydrogen to the first hydrogenation reactor 2 and/or second hydrogenation reactor 3.

The forms of petroleum processing apparatus of the present invention are not limited to those shown in the appended drawings.

The present invention enables the collective and efficient performance of the hydrogenation purification of crude oil distillates, which is commonly carried out individually for each of gas oil, kerosene, heavy naphtha and light naphtha fractions in the art. Further, the present invention enables satisfactorily reducing the sulfur content of obtained individual fractions, especially, heavy naphtha and enables simplifying the oil refining equipment. Thus, oil refining equipment cost and running cost can be reduced. The petroleum processing method and petroleum processing apparatus of the present invention are especially useful when the amount of processed crude oil is small.

EXAMPLE

The present invention will now be illustrated in greater detail with reference to the following Examples, which in no way limit the scope of the invention.

Examples 1 to 6

Crude oil (crude oil consisting of a 50:50 (volume ratio) mixture of Arabian light crude oil and Arabian heavy crude oil, having a sulfur content of 2.40% by weight) was processed by the process shown in FIG. 1. Fraction ratios and sulfur contents (% by weight) of the distillates obtained by the atmospheric distillation of the crude oil are listed in Table 1.

TABLE 1

| Distillate | Fraction ratio (vol %) | S content (wt %) | Composition of distillate to be collectively processed (vol %) |
|---|---|---|---|
| LPG, light gas | 1.8 | — | |
| light naphtha | 11.9 | 0.038 | 12.1 |
| heavy naphtha | 28.0 | 0.028 | 28.5 |
| kerosene | 16.7 | 0.139 | 17.0 |
| gas oil | 41.6 | 1.013 | 42.4 |

Of these fractions, light naphtha, heavy naphtha, kerosene and gas oil fractions were collectively subjected to the first hydrogenation step and the second hydrogenation step.

Hydrogenation conditions employed in the first hydrogenation step and the sulfur contents of the thus obtained fractions are as described below and as given in Table 2. The sulfur content of the whole processed oil was 0.02% by weight.

First Hydrogenation Step

Reactor: gas-liquid downstream parallel flow coil reactor (inside diameter of 8 mm×length of 3500 mm), Catalyst: commercially available Co—Mo catalyst (produced by Catalysts & Chemicals Industries Co., Ltd.), and Amount of catalyst: 175 ml.

TABLE 2

| 1st hydrogenation step | |
|---|---|
| Pressure kg/cm$^2$ | 40 |
| Temperature ° C. | 350 |
| $H_2$/oil Nl/l | 90 |
| LHSV hr$^{-1}$ | 2.84 |
| Results (S content) | |
| Light naphtha S:wtppm | 1.1 |
| Heavy naphtha S:wtppm | 1.6 |
| Kerosene S:wtppm | <100 |
| Gas oil S:wt % | 0.05 |
| Whole processed oil S:wt % | 0.02 |

Hydrogenation conditions employed in the second hydrogenation step and the sulfur contents of the thus obtained fractions are as described below and as given in Table 3.

Second Hydrogenation Step

Reactor: gas-liquid downstream parallel flow coil reactor (inside diameter of 8 mm×length of 2000 mm), Catalyst: commercially available Ni—Co—Mo catalyst (produced by Catalysts & Chemicals Industries Co., Ltd.), and Amount of catalyst: 100 ml.

Comparative Examples 1 and 2

The crude oil was processed in the same manner as in Example 1 except that the hydrogenation conditions of the second hydrogenation step were changed as specified in Table 3. Processing conditions and results are given in Table 3.

TABLE 3

| | 2nd hydrogenation step | | | | Results (S content) | | | |
|---|---|---|---|---|---|---|---|---|
| | Pressure kg/cm$^2$ | Temperature ° C. | $H_2$/oil Nl/l | LHSV hr$^{-1}$ | Light naphtha S:wtppm | Heavy naphtha S:wtppm | Kerosene S:wtppm | Gas oil S:wt % |
| Ex. 1 | 40 | 300 | 90 | 5 | 0.2 | 0.4 | <100 | 0.05 |
| Ex. 2 | 40 | 320 | 90 | 5 | 0.2 | 0.3 | <100 | 0.05 |
| Ex. 3 | 40 | 330 | 90 | 5 | 0.2 | 0.4 | <100 | 0.04 |
| Ex. 4 | 30 | 320 | 90 | 5 | 0.1 | 0.3 | <100 | 0.05 |
| Ex. 5 | 50 | 320 | 90 | 5 | 0.3 | 0.5 | <100 | 0.04 |
| Ex. 6 | 40 | 320 | 90 | 8 | 0.4 | 0.5 | <100 | 0.05 |
| Comp Ex. 1 | 40 | 270 | 90 | 5 | 0.5 | 1.3 | <100 | 0.05 |
| Comp Ex. 2 | 40 | 340 | 90 | 5 | 0.6 | 1.5 | <100 | 0.05 |

Examples 7 to 9

Oil refining was performed by the process of FIG. 2.

Specifically, the same distillates to be collectively processed as in Example 1 were collectively processed in the same manner as in the first hydrogenation step of Example 1 and subjected to atmospheric distillation. The thus obtained heavy naphtha was subjected to the second hydrogenation under the conditions specified in Table 4 and, thereafter, to adsorption. The adsorption was conducted with the use of zinc oxide (ZnO) adsorbent. Processing conditions and results are given in Table 4.

Second Hydrogenation Step

Reactor: gas-liquid downstream parallel flow coil reactor (inside diameter of 8 mm×length of 2000 mm), Catalyst: commercially available Co-Mo catalyst (produced by Catalysts & Chemicals Industries Co., Ltd.), and Amount of catalyst: 100 ml.

Adsorption Step

Adsorber: cylindrical adsorber (inside diameter of 30 mm×length of 400 mm),

Adsorbent: commercially available ZnO adsorbent (produced by Nikki chemical Co., Ltd.), and Amount of adsorbent: 270 ml.

TABLE 4

| Hydrogenation conditions | Example 7 | Example 8 | Example 9 |
|---|---|---|---|
| 2nd hydrogenation step | | | |
| Pressure (kg/cm$^2$) | 15 | 13 | 17 |
| Temperature (° C.) | 360 | 340 | 310 |
| $H_2$/oil (Nl/l) | 40 | 50 | 50 |
| LHSV (hr$^{-1}$) | 8 | 7 | 8 |
| Adsorption step | | | |
| Pressure (kg/cm$^2$) | 15 | 13 | 17 |
| Temperature (° C.) | 360 | 340 | 310 |
| LHSV (hr$^{-1}$) | 3 | 3 | 3 |
| S content of heavy naphtha: wtppm | <0.1 | <0.1 | 0.2 |

What is claimed is:

1. A petroleum processing method to produce a heavy naphtha fraction which has a sulfur content of not greater than 1 ppm by weight, comprising the steps of:

performing an atmospheric distillation of crude oil so that the crude oil is separated into bottoms and distillates, said distillates comprising gas oil and fractions whose boiling point is lower than that of gas oil;

performing a first hydrogenation step by collectively hydrodesulfurizing the distillates in a reactor in the presence of a hydrogenation catalyst selected from the group consisting of Co—Mo, Ni—Mo, Ni—Co—Mo and Ni—W catalysts at 330 to 370° C. under 30 to 70 kg/cm$^2$G; and performing a second hydrogenation step by further collectively hydrodesulfurizing the above hydrodesulfurized distillates in a reactor in the presence of a hydrogenation catalyst selected from the group consisting of Co—Mo, Ni—Mo, Ni—Co—Mo and Ni—W catalysts at 280 to 330° C. under 30 to 70 kg/cm$^2$G at a liquid space velocity (LHSV) ranging from 5 to 10 hr$^{-1}$ to reduce sulfur content of sulfur components formed by the first hydrogenation step undergoing a recombination reaction.

2. The method as claimed in claim 1, which further comprises the steps to be performed after the second hydrogenation step:

separating gas fractions from the hydrodesulfurized distillates (gas separating step); and separating the distillates having undergone the gas separating step into gas oil, kerosene, heavy naphtha and light naphtha fractions (fractionation step).

3. The method as claimed in claim 2, wherein the heavy naphtha fraction obtained in the fractionation step is catalytically reformed to thereby obtain gasoline.

4. The method as claimed in claim 1, wherein the second hydrogenation step is performed at a liquid space velocity (LHSV) range from 5 to 8 hr$^{-1}$.

5. The method as claimed in claim 1, wherein the first hygrogenation step is performed at 350 to 370° C.

6. A petroleum processing method comprising the steps of:

performing an atmospheric distillation of crude oil so that the crude oil is separated into bottoms and distillates, said distillates comprising gas oil and fractions whose boiling point is lower than that of gas oil;

performing a first hydrogenation step by collectively hydrodesulfurizing the distillates in a reactor in the presence of a hydrogenation catalyst selected from the group consisting of Co—Mo, Ni—Mo, Ni—Co—Mo and Ni—W catalysts at 310 to 370° C. under 30 to 70 kg/cm$^2$G;

separating gas fractions from the hydrodesulfurized distillates;

separating the distillates having undergone gas separating step into gas oil, kerosene, heavy naphtha and light naphtha fractions;

performing a second hydrogenation step by hydrodesulfurizing the heavy naphtha fraction obtained in the fractionation step in the presence of a hydrogenation catalyst selected from the group consisting of Co—Mo, Ni—Mo, Ni-—Co—Mo and Ni—W catalysts at 250 to 400° C. under 3 to 30 kg/cm$^2$G; and removing by adsorption sulfur components from the heavy naphtha fraction hydrodesulfurized by the second hydrogenation step.

7. The method as claimed in claim 6, wherein the heavy naphtha fraction obtained in the adsorption step is catalytically reformed to thereby obtain gasoline.

* * * * *

UNITED STATES PATENT AND TRADEMARK OFFICE

CERTIFICATE OF CORRECTION

PATENT NO. : 6,454,934 B2
DATED : September 24, 2002
INVENTOR(S) : Makoto Inomata et al.

It is certified that error appears in the above-identified patent and that said Letters Patent is hereby corrected as shown below:

Column 3,
Line 3, "chronometry" should read -- chromometry --.
Line 17, delete "OBJECT OF THE INVENTION".

Column 9,
Line 18, "unit FIGS. 1," should read -- unit 1, --.

Column 10,
Line 60, "Through 3" should read -- Through FIGS. 3 --.

Signed and Sealed this

First Day of April, 2003

JAMES E. ROGAN
*Director of the United States Patent and Trademark Office*